US007673348B2

(12) United States Patent
Williams

(10) Patent No.: US 7,673,348 B2
(45) Date of Patent: Mar. 9, 2010

(54) USER WEARABLE WIRE CONTROL SYSTEM

(76) Inventor: Herman Williams, 9668 Dartmouth Way, Loveland, OH (US) 45140

( * ) Notice: Subject to any disclaimer, the term of this patent is extended or adjusted under 35 U.S.C. 154(b) by 585 days.

(21) Appl. No.: 11/428,715

(22) Filed: Jul. 5, 2006

(65) Prior Publication Data

US 2007/0028346 A1 Feb. 8, 2007

Related U.S. Application Data

(60) Provisional application No. 60/696,690, filed on Jul. 5, 2005.

(51) Int. Cl.
*A41B 1/00* (2006.01)
*A41D 27/08* (2006.01)

(52) U.S. Cl. ..... 2/115; 2/244

(58) Field of Classification Search ..... 2/114, 2/83, 115, 249, 209, 244
See application file for complete search history.

(56) References Cited

U.S. PATENT DOCUMENTS 4,070,553 A * 1/1978 Hass ..... 381/301
4,087,864 A * 5/1978 LaBove et al. ..... 2/102
4,531,942 A * 7/1985 Turner ..... 604/180
4,582,508 A * 4/1986 Pavelka ..... 604/179
4,688,270 A * 8/1987 Denicola et al. ..... 2/102
4,718,124 A * 1/1988 Sawicki et al. ..... 2/114
4,799,923 A * 1/1989 Campbell ..... 604/179
4,876,724 A * 10/1989 Suzuki ..... 381/385
5,293,840 A * 3/1994 Wedlick ..... 119/850
5,375,265 A * 12/1994 Selzer ..... 2/242
5,403,285 A * 4/1995 Roberts ..... 604/179
5,611,085 A * 3/1997 Rasmussen ..... 2/102
5,708,978 A * 1/1998 Johnsrud ..... 2/102
5,897,519 A * 4/1999 Shesol et al. ..... 602/79
6,032,289 A * 3/2000 Villapiano ..... 2/102
6,178,559 B1 * 1/2001 Dennis et al. ..... 2/400
6,206,854 B1 * 3/2001 Weaver ..... 604/174
6,450,168 B1 * 9/2002 Nguyen ..... 128/869
6,460,187 B1 * 10/2002 Siegel ..... 2/114
6,477,710 B1 * 11/2002 Ojoyeyi ..... 2/69
6,707,922 B2 * 3/2004 Tilbury et al. ..... 381/333
6,792,124 B2 * 9/2004 Tilbury et al. ..... 381/333
6,818,816 B2 * 11/2004 Roberts et al. ..... 84/723
6,826,782 B2 * 12/2004 Jordan ..... 2/94
7,073,204 B1 * 7/2006 Boyles ..... 2/114
7,418,741 B2 * 9/2008 Rogers ..... 2/114
7,425,206 B2 * 9/2008 Byrne et al. ..... 604/174
7,519,192 B1 * 4/2009 Laycock et al. ..... 381/301

(Continued)

*Primary Examiner*—Alissa L Hoey
(74) *Attorney, Agent, or Firm*—Douglas A. Scholer

(57) ABSTRACT

A user wearable wire control system and associated processes that can be utilized to control a dangling wire along a user's body. The user wearable wire control system includes a first layer and second layer that are configured to form a sleeve with a hollow portion disposed therein. The sleeve is adapted to encase a least a portion of a wire. The sleeve includes a first aperture at a first end portion configured to allow at least a portion of the wire to enter the sleeve and a second aperture at a second end portion configured to allow at least a portion of the wire to exit the sleeve. As such, a wire that would otherwise dangle loosely along the body of a user may be at least partially encased in the sleeve and may reduce the danger and/or inconvenience of a dangling wire.

11 Claims, 4 Drawing Sheets

U.S. PATENT DOCUMENTS

2004/0226073 A1* 11/2004 McCullar et al. ..... 2/114
2006/0037124 A1* 2/2006 Cho et al. ..... 2/114
2006/0075537 A1* 4/2006 Tsai ..... 2/69
2006/0099864 A1* 5/2006 Crumrine et al. ..... 441/106
2006/0185062 A1* 8/2006 Peng et al. ..... 2/209.13
2007/0157362 A1* 7/2007 Rogers ..... 2/114
2007/0245444 A1* 10/2007 Brink ..... 2/69
2008/0184455 A1* 8/2008 Blume ..... 2/114
2008/0184459 A1* 8/2008 Barnes ..... 2/249
2009/0031474 A1* 2/2009 Komorowski ..... 2/114

* cited by examiner

USER WEARABLE WIRE CONTROL SYSTEM

PRIORITY CLAIM

This application claims benefit of priority of U.S. provisional application Ser. No. 60/696,690 titled "Upper Outer Garment with Stereo Headphone Cable Control System" filed Jul. 5, 2005, whose inventor is Herman Williams. U.S. provisional application Ser. No. 60/696,690 is incorporated herein by reference in its entirety and for all purposes.

FIELD OF INVENTION

The present invention relates generally to listening devices and headphones, and in particularly, listening devices that are attached to headphones devices by wires, cables, or cords.

BACKGROUND OF THE INVENTION

Improvements in technology have caused an increase in the number of listening devices and headphone devices available to users. Generally, the listening device is the source of the sound and a headphone device is used by a user to listen to the sound.

There are a variety of listening devices such as a telephone, a cassette player, a CD player, a radio player, a MP3 player, an electronic device with a memory, etc. Listening devices are typically worn by a user on his or her waist. The headphone device, also referred to as a earphone or a stereophone or simply headphone, generally includes one or more speakers to convert a electrical signal into audible sound waves, and each speaker is placed in close proximity to a user's ears or in the user's ears. One or more wires generally dangle loosely along the user's body and attach the headphone to the listening device. The electrical signal travels along the wire from the listening device to the headphone. Some headphones, referred to as headsets, also have a transmitter which allows a user to speak and transmit a message.

The use of headphones is prolific. Headphones are used professionally, for example, by performers and by television reporters and television hosts. Headphones are also worn for personal use, for example, while exercising. However, because a wire generally dangles loosely along the body of the user, it can be inconvenient and even threaten the safety of a user. For instance, a wire can become entangled when a user is operating multiple listening devices (e.g., a CD player and a telephone). Similarly, the wire may become entangled with a user's clothing or machinery (e.g., exercise equipment).

Although some headphones function wirelessly (e.g., via bluetooth technology) and do not include a wire, the sound quality of these wireless headphones may not be as good as the sound quality of headphones with wires.

A need therefore exists for controlling a dangling wire.

SUMMARY OF THE INVENTION

The invention addresses these and other problems associated with the prior art by providing a user wearable wire control system and associated processes that address the shortcomings discussed above. Namely, the user wearable wire control system includes a first layer and a second layer that are configured to form a sleeve with a hollow portion disposed therein. The sleeve is adapted to encase at least a portion of a wire. The sleeve includes a first aperture at a first end portion configured to allow at least a portion of the wire to enter the sleeve and a second aperture at a second end portion configured to allow at least a portion of the wire to exit the sleeve. As such, a wire that would otherwise dangle loosely along the body of a user may be at least partially encased in the sleeve and may reduce the danger and/or inconvenience of a dangling wire.

Practically any two layers may be used to form the sleeve. The sleeve may be formed out of two unattached layers which may be subsequently attached together or the two layers may be a complete unit and not need to be further attached to each other. One of the layers, such as the second layer, may even be a portion of a garment a user may be wearing. As such, the first layer may be attached to the garment (i.e., the second layer) to form the sleeve. The two layers of the sleeve may even be incorporated or integral to a garment. In other words, an additional layer may be built into a garment during manufacture of the garment to form a sleeve. When the sleeve is not incorporated into a garment, the first layer may be attached to a portion of a garment (i.e., the second layer) to form a sleeve or the sleeve (both the first and second layers) may be attached to a garment. As such, a sleeve consistent with the present invention refers to practically any sleeve that may be created to encase at least a portion of a wire regardless of whether one of the layers is a portion of a garment, the two layers are a complete unit, layers are incorporated into a garment, etc.

Practically any material may be used for the first layer and the second layer forming the sleeve. The same material may be used for each layer or one layer may be a different material than the other layer. Practically any kind of material may be used for a layer. For instance, the material may be partially or completely plastic, cotton, rayon, spandex, or any cloth material, among others. A portion of the material is preferably satin. The material may preferably have a smooth texture but may have a non-smooth texture. The thicknesses associated with the various layers forming the sleeve may vary based upon the material used.

The sleeve may be placed on (e.g., attaching the first layer and using the garment as the second layer) or incorporated into practically any garment such as shirts, dresses, pants, undergarments, socks, shorts, or practically any other type of garment. Moreover, the sleeve may be placed on or incorporated into a carrying device or other type of article a user may wear or may carry, for instance, a jacket, an overcoat, a backpack, etc.

At least a portion of the sleeve (e.g., a portion of the first layer, a portion of the second layer, etc.) may be exterior of a garment or interior of a garment. In both instances, the first layer and/or the second layer may be a portion of the garment. The location of the first aperture and/or second aperture may vary based upon the location of the sleeve (e.g., exterior or interior of a garment). The first aperture may be in the first end portion, which may include the first layer and/or second layer approximately in the first end portion, and the second aperture may be in the second end portion, which may include the first layer and/or second layer approximately in the second end portion. The first end portion, as used herein, may include the first layer and/or second layer approximately in the first end portion area, and the second end portion, as used herein, may include the first layer and/or second layer approximately in the second end portion area.

When at least a portion of the sleeve is exterior to the garment, the first aperture and/or second aperture may also be exterior to the garment and for example, in the first end portion and second end portion, respectively. The first aperture and/or second apertures may also be in the first layer. When at least a portion of the sleeve is interior to the garment, at least one of the first end portion or the second end portion of the sleeve may be in contact with the garment, which may also be the second layer, and at least one of the first aperture of the first end portion or the second aperture of the second end portion provide access from exterior of the garment through the garment to the sleeve. In other words, when the sleeve is interior to a garment, the first aperture may be an opening in the garment such that from the exterior of the garment a user may insert the wire through the first aperture to the first end portion of the sleeve. Preferably, the first aperture is in the garment or the second layer, but the first aperture may be an opening in the sleeve interior to the garment in the first layer.

The inserted wire may be guided through the sleeve by a pull string by the user through an intermediate portion to the second end portion and the wire may exit through a second aperture. The second aperture may also be an opening in the garment, the second layer, such that the wire may exit exterior to the garment or may be an opening in the sleeve or in the first layer such that the wire exits interior to the garment.

Moreover, while the user wearable wire control system may have particular application to wires connecting a headphone device to a listening device, the principles of the invention may additionally apply to other types of electronic wires (e.g., wire of an i-pod, microphone wire, equipment used by reporters, etc.) and non-electronic wires that may dangle along a user's body. For example, users that wear insulin pumps generally have a dangling wire connecting the insulin pump to the insertion site on the user's body, with the insulin from the insulin pump traveling through the wire to the insertion site and directly into the user's system. As such, users that wear insulin pumps may appreciate that the user wearable wire control system described herein may be used to control this dangling wire as well. Thus, the user wearable wire control system may be applicable for controlling practically any wire that would otherwise dangle along, on, and/or around a user's body.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
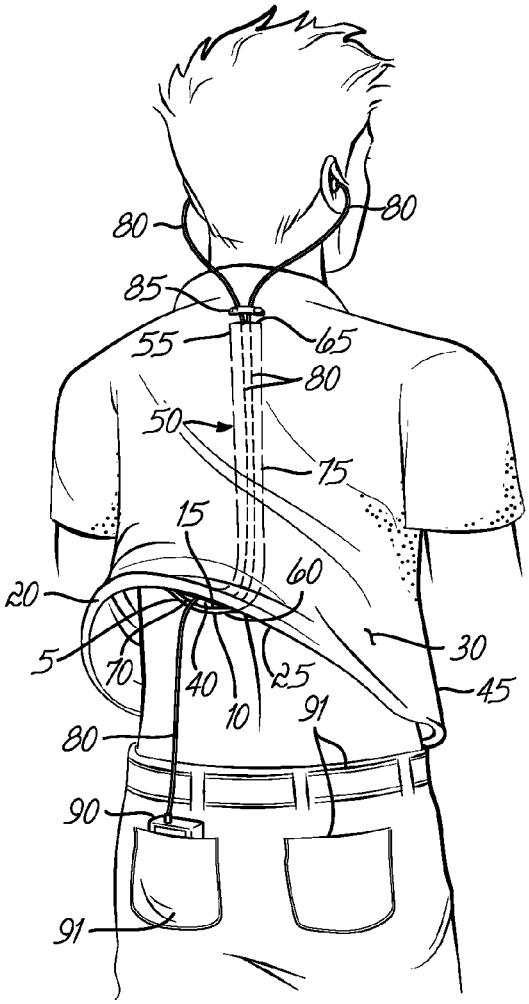
FIG. 1 illustrates a user wearable wire control system consistent with the principles of the present invention worn by a user.

FIG. 1 illustrates a user wearable wire control system consistent with the principles of the present invention worn by a user. FIG. 1 illustrates at least a portion of sleeve 50 interior to garment 45 worn by the user. Sleeve 50 is formed by first layer 5 and second layer 20, and second layer 20 is composed of a portion of garment 45. First layer 5 has a top surface 10 and a bottom surface 15. Second layer 20 has a top surface 25 and a bottom surface 30. The first layer 5 may be attached to the second layer 20, which is also garment 45, and will be discussed in detail in connection with FIGS. 2A, 2B, 2C, and 2D, or may be incorporated into garment 45. Sleeve 50 also has a hollow 40, a first end portion 55 with a first aperture 65, a second end portion 60 with a second aperture 70, and an intermediate portion 75 dispose between the first end portion 55 and the second end portion 60. As used herein, first end portion and second end portion may, but need not refer to the ultimate ends of the sleeve. The dashed lines depict wires 80 as being partially encased by sleeve 50.

As illustrated in FIG. 1 by the dashed lines of sleeve 50, at least a portion of sleeve 50 is interior to garment 45 worn by the user because although the second layer 20 is garment 45, the first layer 5 is inside garment 45. As such, first aperture 65 is depicted as being an opening in garment 45, the second layer 20 of sleeve 50, to facilitate the entrance of wires 80 into first aperture 65 to the first end portion 55 of sleeve 50. Once inside, wire 80 may be guided through hollow 40 through intermediate portion 75 to second end portion 60 and out through second aperture 70. Although second aperture 70 is depicted as allowing the wire to exit underneath garment 45, those of ordinary skill in the art may recognize, as depicted in FIG. 1A, that second aperture 70 may alternatively be an opening on garment 45, which may also be the second layer 20, to permit the wire 80 to exit exterior to garment 45 as depicted in FIG. 1A instead of interior to garment 45 as depicted in FIG. 1.

Nonetheless, returning to FIG. 1, once wire 80 exits second aperture 70, wire 80 may be connected to a listening device or other device 90. Next, device 90 may be attached to a holder 91 such as a belt, pocket, etc. Device 90 may be attached, for example, by a clip to a belt or other area desired by a user. Practically any location in which a device 90 may be attached or stored may be used.

Additionally, optionally, anchor 85 may be used to further secure wires 80 to a garment as depicted in FIG. 1. Anchor 85 may preferably be removably attached to garment 45 to allow a user to secure the wires to garment 45 but need not be. Part of the anchor may be stitched and the other part may be buttoned or removably attached. The anchor may be made out of elastic or some other material described herein. The anchor may be an elastic loop with the length being approximately one half inch (i.e., ½ inch).

Figure 1A:
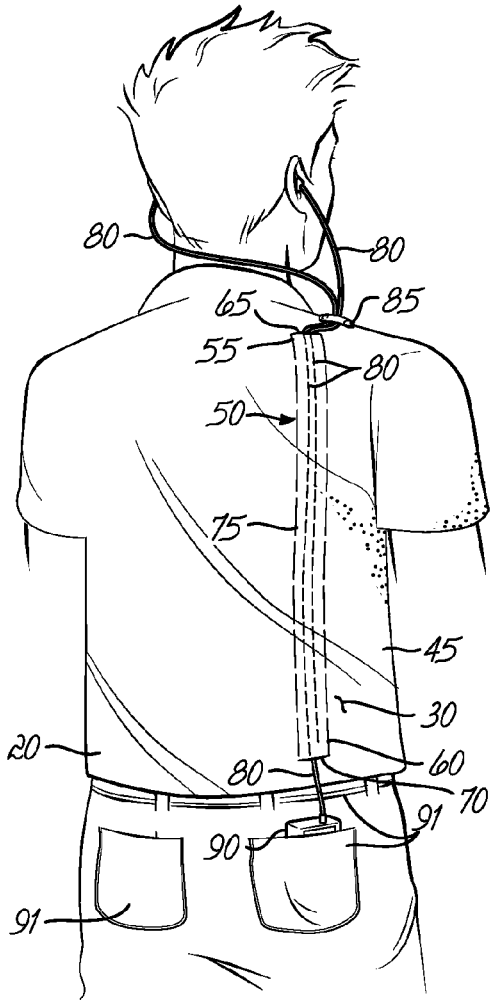
FIG. 1A illustrates a user wearable wire control system consistent with the principles of the present invention worn by a user.

FIG. 1A also depicts a user wearable wire control system consistent with the principles of the present invention worn by a user. In particular, some of the differences between FIG. 1 and FIG. 1A are the location of the sleeve, the location of the anchor, and the location of device 90. Similar to FIG. 1, at least a portion of the sleeve 50 is interior to garment 45 but second aperture 70 is an opening in garment 45, the second layer 20, as opposed to below garment 45 in FIG. 1. Generally, FIGS. 1 and 1A are right side out rear views but may be adapted to be in-side out rear views.

Additionally, anchor 85 is placed in a different position on garment 45 and closer to the shoulder of a user. As such, a user may be able to more readily use the anchor to secure his or her wires and prevent them from falling to a less accessible location. One of ordinary skill in the art may appreciate that although anchor 85 is optional, it may be helpful to a user to be able to remove a wire or wires from their ears and let the wire or wires drop, such as headphone wire, but not drop to the floor or get lost or damaged. Anchor 85 ensures that the wires are generally accessible to the user and remain safe. Furthermore, anchor 85 may limit the amount of travel of wire 80 through sleeve 50 such that wire 80 does not travel completely through first aperture 65 and out second aperture 70. Some alternative uses for anchor 85 are illustrated in FIGS. 3, 4A, 4B, and 5 and will be discussed in greater detail in connection with these FIGS.

Returning to FIG. 1A, sleeve 50 is also depicted towards the right of garment 45 on the back of a user and as such, device 90 is connected to wire 80 and placed in holder 91 to the right. Additionally, sleeve 50 may be placed on the front of a garment, on the back or rear of a garment, on the side of a garment, for example, along the user's side, or practically on any other location on a garment. Furthermore, sleeve 50 may be placed on practically any garment such as shirts, dresses, pants, undergarments, socks, shorts, or practically any other type of garment. Moreover, sleeve 50 may be placed in a carrying device or other type of article a user may wear or may carry, for instance, a jacket, an overcoat, a backpack, etc. The placement of the user wearable wire control system also need not be vertically placed. Instead, it may be placed horizontally, diagonally, etc. The layers forming the sleeve may also be discontinuous, or continuous as generally depicted in FIGS. 1 and 1A.

Figure 2A:
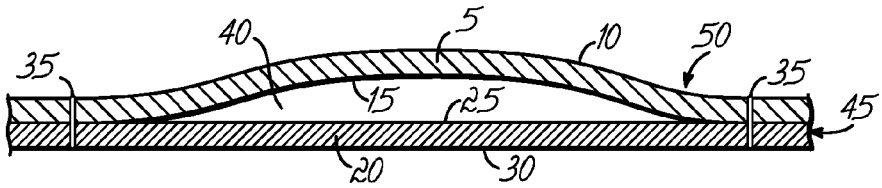
FIG. 2A shows a cross-sectional view of a user wearable wire control system in accordance with the principles of the present invention and suited to be worn by a user as illustrated in FIG. 1.

Turning now to FIG. 2A, FIG. 2A illustrates a cross section of first layer 5 and second layer 20, which form sleeve 50. First layer 5 includes a top surface 10 and bottom surface 15, and second layer 20 includes a top surface 25 and a bottom surface 30. First layer 5 and second layer 20 are attached to each other by two attachments 35. In some embodiments, less than or more than two attachments 35 may be used. Attachment 35 may be practically any type of attachment, for example, a safety pin, button, zipper, stitching, etc. It is worth noting that first layer 5 and second layer 20 are configured to form a hollow 40 such that at least a portion of wire 80 may be encased in hollow 40 of sleeve 50.

Furthermore, in FIG. 2A, second layer 20 may also be a portion of garment 45 worn by a user. As such, a user wearing garment 45 may use attachment 35 to attach first layer 5 to garment 45, so that garment 45 serves as second layer 20 and a sleeve is created by attaching first layer 5 to second layer 20. The different shading of first layer 5 and second layer 20 indicate that these layers are made from different materials. Furthermore, the sleeve is described herein in terms of a first layer and a second layer which may be a portion of garment 45, however, the terminology may be reversed such that the first layer is referred to as the second layer and vice versa consistent with the principles of the invention. Moreover, in some embodiments there may be more than two layers to the sleeve, for instance, a third layer disposed within sleeve 50.

Figure 2B:
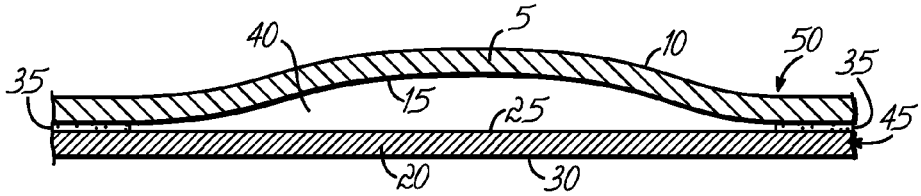
FIG. 2B shows a cross-sectional view of a user wearable wire control system in accordance with the principles of the present invention and suited to be worn by a user as illustrated in FIG. 1.

Next, FIG. 2B illustrates a cross section similar to that of FIG. 2A. The primary difference is attachment 35 attaching the first layer 5 to the second layer 20. In FIG. 2A, attachment 35 is an adhesive such as glue, velcro, etc. As such, a user may apply an adhesive to the first layer 5 and/or second layer 20 to attach the two layers and form sleeve 50, with hollow 40 disposed therein.

Figure 2C:
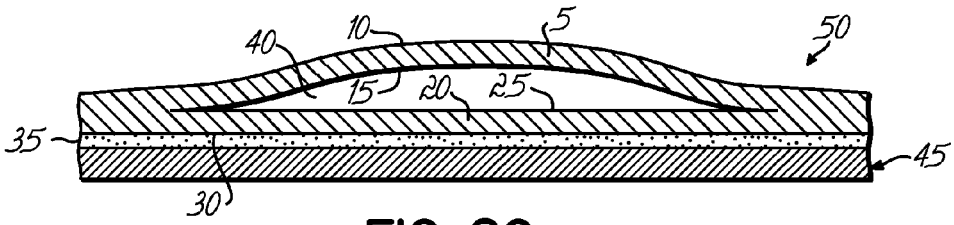
FIG. 2C shows a cross-sectional view of a user wearable wire control system in accordance with the principles of the present invention and suited to be worn by a user as illustrated in FIG. 1.

In FIG. 2C, first layer 5 and second layer 20 are the same material because they are both depicted with the same shading, and form one complete unit. Therefore, an attachment 35 may not be needed to attach first layer 5 to second layer 20. However, an attachment 35 is illustrated in FIG. 2C to indicate that the sleeve 50 may be attached to a garment 45. Attachment 35 may be practically any adhesive including those described above and may be utilized to attach bottom surface 30 of second layer 20 to garment 45, either above garment 45 and therefore exterior to the garment or below garment 45 and therefore interior to garment 45.

As can be seen from FIGS. 2A, 2B, and 2C, at least a portion of sleeve 50 is attachable to garment 45, either to the interior or exterior of garment 45. In particular, first layer 5 is attachable to second layer 20 and vice versa as depicted in FIGS. 2A and 2B to form sleeve 50. On the other hand, the bottom surface 30 of second layer 20 of complete unit of first layer 5 and second layer 20 forming sleeve 50 is attachable to a garment 45 as depicted in FIG. 2C. Where a first layer 5 is attached to garment 45, such that garment 45 serves as second layer 20, no further attachment other than attachment 35 in FIG. 2A or 2B may be needed. Preferably, at least a portion of the sleeve is removably attachable to garment 45.

Practically any adhesive, fastener, zipper, a button, etc. may be used for attachment 35 in FIGS. 2A, 2B, and 2C. Preferably, first layer 5 of FIGS. 2A and 2B and the complete unit of first layer 5 and second layer 20 forming sleeve 50 of FIG. 2C are removably attached to garment 45, for example, via a zipper, velcro, etc. One or both sides (e.g., as in FIGS. 2A and 2B) of sleeve 50 may be attached. Furthermore, heat may be applied to attach either first layer 5 to garment 45 or the complete unit of first layer 5 and second layer 20 to garment 45. For instance, the sleeve of FIG. 2C may be ironed onto garment 45, and the application of heat will attach sleeve 50 to garment 45. Additionally, at least one of bottom surface 15 of first layer 5 or top surface 25 of second layer 20 may be padded or lined with cotton, foam, or practically any type of padding material.

Figure 2D:
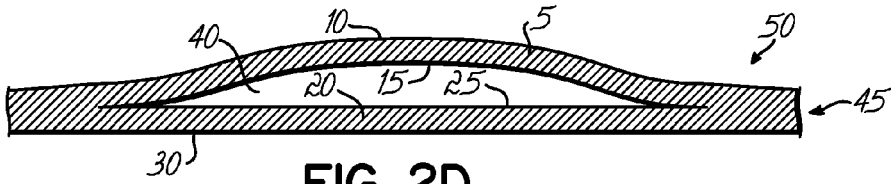
FIG. 2D shows a cross-sectional view of a user wearable wire control system in accordance with the principles of the present invention and suited to be worn by a user as illustrated in FIG. 1.

FIG. 2D illustrates a sleeve that is integral or incorporated into garment 45. As such a separate attachment 35 may be avoided because either a first layer 5 or a second layer 20 is incorporated into the garment 45 when garment 45 is manufactured. Although incorporated into garment 45, one of the layers may be exterior to the garment or interior to the garment depending on the placement of sleeve 50.

Figure 3:
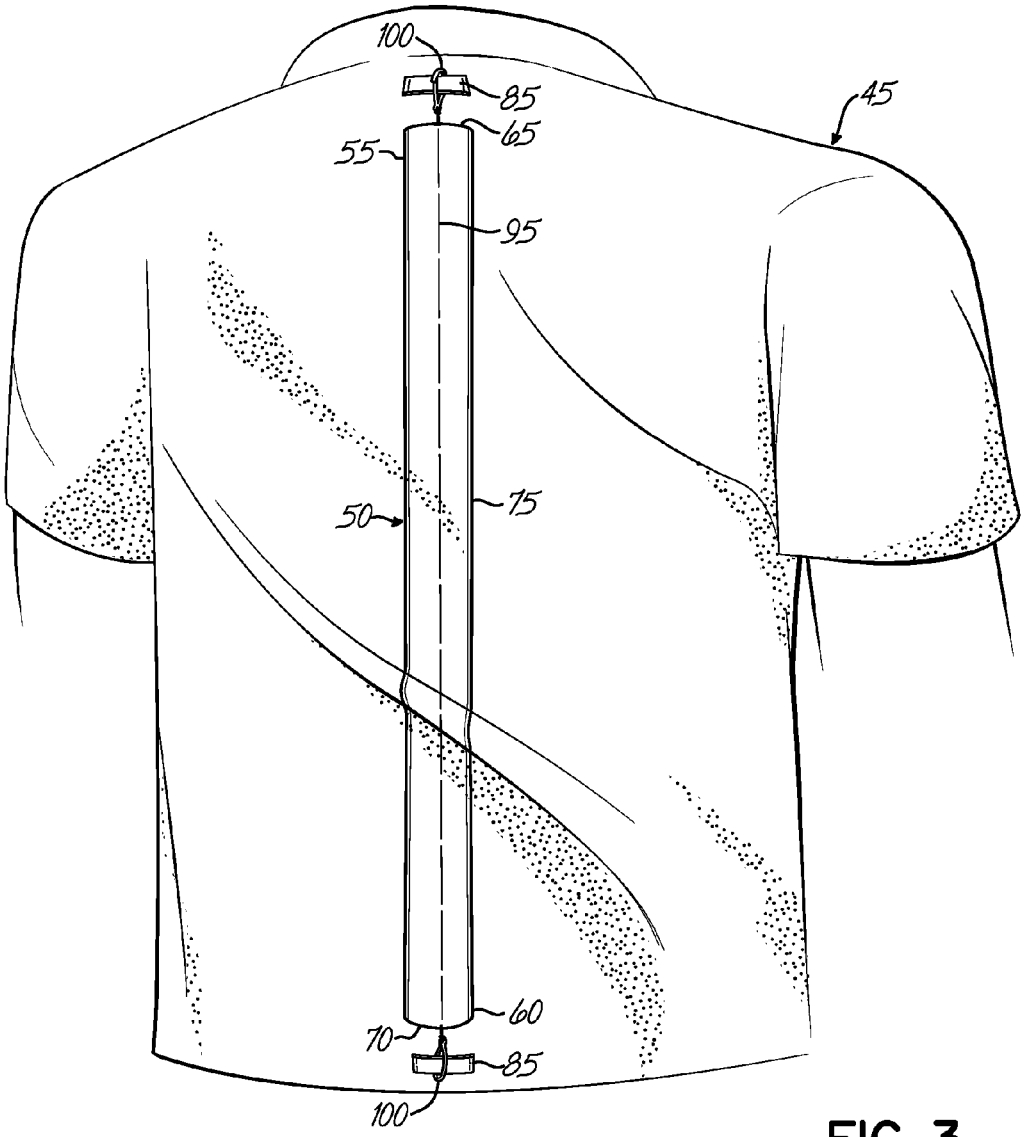
FIG. 3 illustrates a pull string within a user wearable wire control system consistent with the principles of the present invention worn by a user.

FIG. 3 illustrates a user wearable wire control system consistent with the principle of the present invention worn externally by a user. The view of FIG. 3 is generally that of a right side out rear view. As can be seen by the solid lines of sleeve 50, the user is wearing at least a portion of the sleeve external to garment 45 (e.g., the second layer 20 may be the garment 45 to make sleeve 50 with the first layer 5 external, the sleeve 50 may be a complete unit attached to garment 45 with both layers external, first and second layers may be incorporated into garment 45 with first layer 5 external, etc.) with pull string 95 still underneath or inside hollow 40 of sleeve 50. Pull string 95 may be utilized by a user to guide wire 80 through first aperture 65 to first end portion 55 through intermediate portion 75 to second end portion 60 and out second aperture 70 of sleeve 50. As such, at least a portion of wire 80 may be in hollow 40 and encased by sleeve 50.

Additionally, pull string 95 may have at least one fastener 100 at one of the ends of the pull string. Fastener 100 may be practically any fastener such as a c-clip, x hook, a carabiner, or practically any other type of fastener that can be attached to pull string 95. Fastener 100 may be spring loaded or not spring loaded and may be attached to anchor 85 or to a pouch. Preferably, the fastener is removably attached to anchor 85. Anchor 85 may be on at least a portion of the sleeve 50 (e.g., on second layer 20 which is garment 45) or on garment 45 when garment 45 is not one of the layers of sleeve 50. Although the embodiment depicted in FIG. 3 has a fastener 100 at each end, and each fastener is attached to an anchor, such need not be the case.

A user may use pull string 95 to guide a wire 80 through sleeve 50 by detaching fastener 100 from anchor 85 and attaching the end of wire 80 to the fastener 100 and deattaching the second fastener 100 at the bottom end of pull string 95 and pulling the pull string through the sleeve along with the attached wire. As such, the wire may be guided via the pull string through the first end portion 55, the intermediate portion 75, and to the second end portion 60, and out second aperture 70. As at least a portion of sleeve 50 is exterior to garment 45, wire 80 may enter exterior to garment 45 and at least a portion of wire 80 will exit exterior to garment 45. With the remaining portions of wire 80 encased in sleeve 50. Although the use of a pull string in FIG. 3 is associated with two anchors and two fasteners, in some embodiments, this need not be the case. On the other hand, more than two anchors may be used, for instance where more than one pull string is used. To remove the wire from sleeve 50, the user may attach the bottom fastener to the bottom anchor, pull the wire 80 back up through the sleeve 50 and reattaching the pull string's top fastener to the top anchor.

Figure 4A:
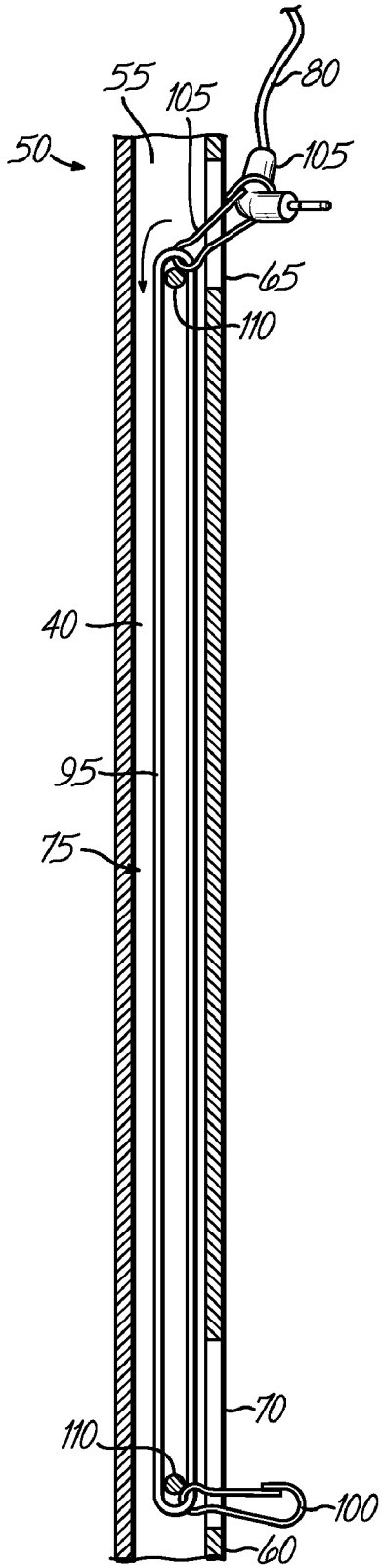
FIG. 4A illustrates a pull string in the form of a conveyor belt within a user wearable wire control system consistent with the principles of the present invention utilized to guide the wire through the sleeve.
Figure 4B:
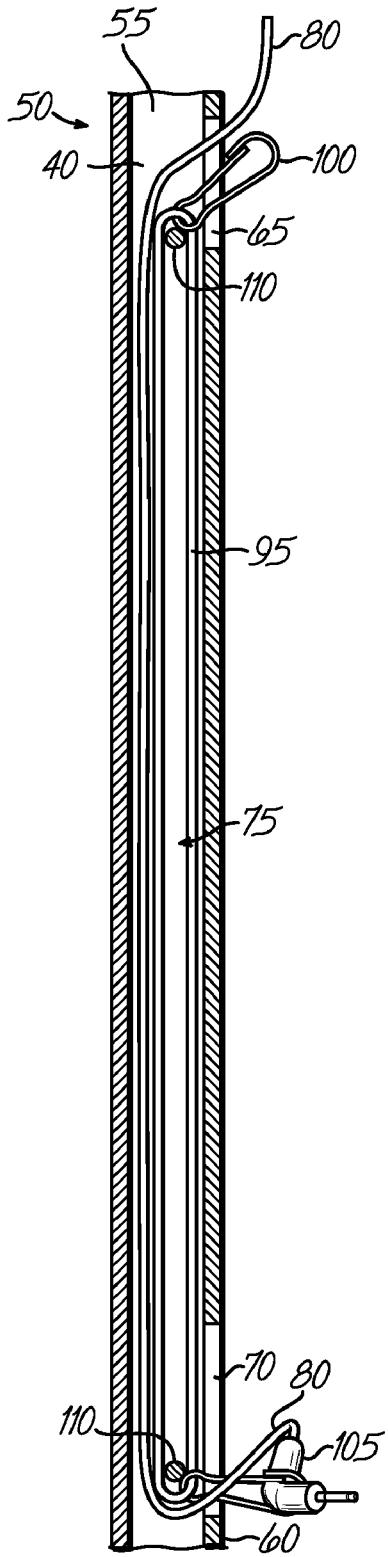
FIG. 4B illustrates a pull string in the form of a conveyor belt within a user wearable wire control system consistent with the principles of the present invention utilized to guide the wire through the sleeve.

Next, FIGS. 4A and 4B illustrate cross sections of sleeve 50. The vertical layer to the left and the vertical layer to the right in each figure are the first layers and the second layers. However, those of ordinary skill in the art may appreciate that these layers are not numbered because the layer to the left may either be the first layer 5 or the second layer 20 and the layer to the right may either be the first layer 5 or the second layer 20 depending upon where sleeve 50 is located on a garment. For instance, as depicted in FIGS. 1 and 1A, if garment 45 is relied upon as the second layer then the first layer 5 may be interior to the garment and it is the second layer comprising that may have first aperture 65 and second aperture 70. On the other hand, as illustrated in FIG. 3, at least a portion of sleeve 50 is exterior to the garment and the first layer 5 may have the first aperture 65 and the second aperture 70. As such, the layers of sleeve 50 are not numbered in FIGS. 4A and 4B.

FIG. 4A and FIG. 4B generally illustrate another manner in which a user may guide a wire 80 into, through, and out sleeve 50. An anchor 85 (illustrated in FIG. 3) may not be utilized in connection with FIG. 4A and FIG. 4B. Generally, a user may provide a wire 80 and may attach fastener 100 to wire end 105 of wire 80. Fastener 100 is attached to pull string 95 inside sleeve 50 in FIGS. 4A and 4B, and pull string 95 is in the shape of a conveyer belt. Its shape is maintained via two conveyer belt fasteners 110. Fastener 100 may protrude out of the sleeve via first aperture 65, or may be inside the sleeve and accessible via aperture 65.

Returning to wire end 105, a user may attach this wire end 105 to fastener 100 and maneuver pull string 95 via second aperture 70 using an upward motion. As such, the wire end 105 may enter the sleeve via the first aperture 65 into the first end portion 55 of the sleeve and downwards towards the intermediate portion of sleeve 50 to the second end portion 60. The user can detach wire end 105 from fastener 100 via second aperture 70 and attach wire 80 and/or wire end 105 to device 90. The insertion of wire 80 is generally depicted in FIG. 4A and the removal of wire 80 is generally depicted in FIG. 4B. Thus, as depicted in FIG. 4B, that at least a portion of wire 80 will be encased in sleeve 50, the portion that is encased may depend upon the length of the sleeve 50. Furthermore, pull string 95 is within the hollow portion 40 of sleeve 50 and may have more than one fastener as depicted in FIG. 4A and FIG. 4B. As such, when the wire 80 is at the point of removal via second aperture 70, another fastener 100 has been maneuvered upwards and is available for attaching a second wire 80. Those of ordinary skill in the art may appreciated that the surfaces inside sleeve 50, bottom surface 15 of first layer 5 and the top surface 25 of second layer 20 may be padded to minimize what a user wearing the sleeve 50 feels.

Figure 5:
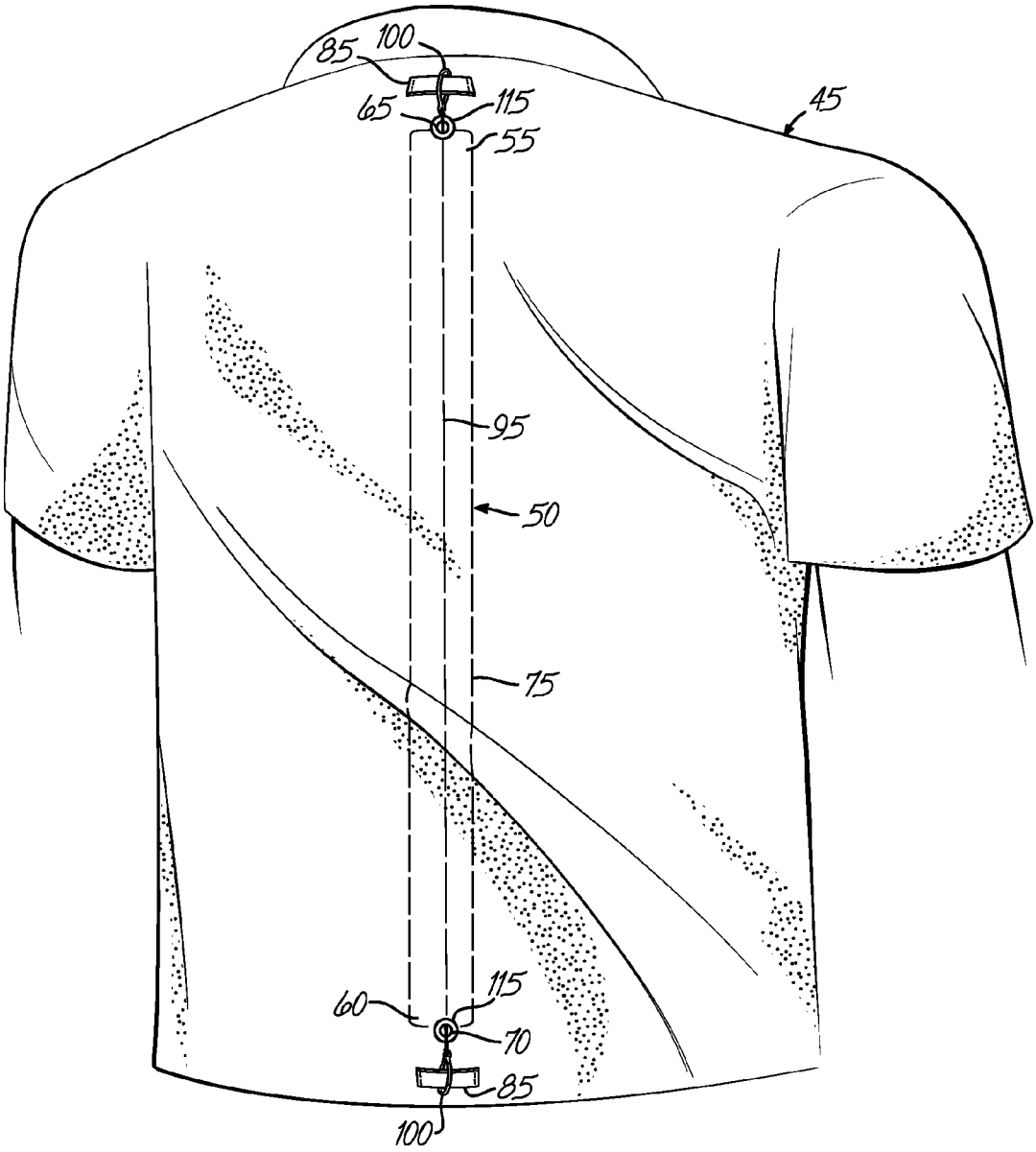
FIG. 5 illustrates a pull string within a user wearable wire control system consistent with the principles of the present invention worn by a user.

FIG. 5 also depicts a user wearable wire control system consistent with the principle of the present invention and worn by a user. The dashed lines of sleeve 50 indicate that at least a portion of the sleeve 50 is interior to garment 45. FIG. 5 is similar to FIG. 3 except that the first aperture 65 of first end portion 55 has a reinforced opening 115. Similarly, the second aperture 70 of second end portion 60 also has a reinforced opening 115. The apertures are on the second layer 20, which is also garment 45. Practically any type of reinforcement to an opening may be used such as an elastic or rubber reinforcement or a metallic reinforcement. However, the reinforced opening 115 should be sufficiently large to permit a wire end such as wire end 105 to fit through this opening. The size of the opening may generally be dictated by the wire and/or wire ends as wires and wire ends vary in size and shape. The fastener can be spring loaded and alternatively, the fastener can attach to a pouch instead of the anchor.

Additionally, one of ordinary skill in the art may appreciate that the length of sleeve 50 may be longer than that depicted in FIG. 5 or in the other FIGS. For instance, the first end portion 55 may be closer to the collar of garment 45 and/or the second end portion 60 of sleeve 50 may be closer towards the tip of garment 45. As such, the wire 80 may be inserted interior to garment 45, and the apertures may be completely interior to garment 45 on first layer 5. In such an embodiment, one or both anchors 85 depicted in FIG. 5 may also be interior to garment 45 and the pull string fastener 100 may also be interior to garment 45. Alternatively, the pull string may be in the form of a conveyer belt and anchors 85 may be avoided. Thus, a user may insert a wire into a sleeve and attach it to fastener 100 as generally described in FIGS. 4A and 4B.

As generally depicted in FIGS. 1-5, at least a portion of sleeve 50 may be interior or exterior to garment 45. A sleeve 50 may be interior to garment 45 when garment 45 is the second layer 20. This second layer 20 may have first and second apertures. Alternatively, sleeve 50 may be interior to the garment when the second layer 20 is not garment 45. The first and second apertures may be on first layer 5. Moreover, at least a portion of sleeve 50 may be exterior to garment 45.

In such an instance, the first layer 5 may have the first and second apertures or alternatively the second layer may be garment 45 and may have the first and second apertures. Additionally, the location of the first and second apertures may depend upon the shape of the first and second apertures, for instance, whether they are horizontal slits as depicted in FIGS. 1, 1A, and 3 or whether they are reinforced and generally openings limited in size as depicted in FIG. 5.

Furthermore, a pull string either with anchors and fasteners or a pull string in the form of a conveyer belt along with fasteners may be used to guide a wire 80 and/or the wire ends through sleeve 50. An anchor may also be used to additionally secure a wire 80. Although anchor 80 is generally depicted in the drawings as attached to garment 45, anchor 85 may also be attached to sleeve 50. Those with ordinary skill in the art may appreciate that the user wearable wire control system described herein may be modified in various ways consistent with the principles of the present invention.

Generally the wire control system of the present invention provides a convenient, functional, and safe system for controlling a wire that is generally hands free, simple to use, may work with practically any wire that hangs loosely along a users body, and may eliminate the danger and inconvenience associated with dangling wires.

Various modifications may be made to the illustrated embodiments without departing from the spirit and scope of the invention. Therefore, the invention lies in the claims hereinafter appended.

What is claimed is:

1. A user wearable wire control garment, comprising:

an upper torso garment;

a first layer, wherein at least a portion of the first layer has a top surface and a bottom surface;

a second layer, wherein at least a portion of the second layer has a top surface and a bottom surface;

the first layer and the second layer are configured to form a sleeve with a hollow portion disposed therein, said sleeve incorporated in the upper torso garment and adapted to encase at least a portion of an electronic wire connected to a sound-producing device, wherein said sleeve comprises:

a first end portion;

a second end portion;

an intermediate portion disposed between the first end portion and the second end portion;

a first aperture at the first end portion configured to allow at least a portion of the wire to enter the sleeve;

a second aperture at the second end portion configured to allow at least a portion of the wire to exit the sleeve;

a first anchor attached the garment adjacent to the first aperture;

a second anchor attached the garment adjacent to the second aperture; and a pull string positioned within the sleeve, the pull string including a first fastener that is removably attachable to the first anchor and a second fastener that is removably attachable to the second anchor.

2. The user wearable wire control system of e aim 1, wherein at least a portion of the sleeve is attachable interior to the garment.

3. The user wearable wire control system of claim 1, wherein at least a portion of the sleeve is removably attachable to the garment.

4. The user wearable wire control system of claim 1, wherein at least a portion of the sleeve is interior to a garment, at least one of the first end portion or the second end portion of the sleeve are in contact with the garment and at least one of the first aperture of the first end portion or the second aperture of the second end portion provide access from exterior of the garment through the garment to the sleeve.

5. The user wearable wire control system of claim 1, wherein the second layer is a portion of a garment.

6. The user wearable wire control system of claim 5, wherein the first layer is attachable to the second layer.

7. The user wearable wire control system of claim 1, wherein at least a portion of the anchor is removably attachable to a garment.

8. The user wearable wire control system of claim 1, wherein the anchor is utilized to secure a portion of the wire that is not encased in the sleeve to the garment.

9. The user wearable wire control system of claim 1, wherein at least a portion of the sleeve is interior to the garment, at least one of the first end portion or he second end portion of the sleeve are in contact with the garment and at least one of the first aperture of the first end portion or the second aperture of the second end portion provide access from exterior of the garment through the garment to the sleeve and wherein the anchor is on the exterior of the garment.

10. The user wearable wire control system of claim 1, wherein the pull string is in the shape of a conveyor belt.

11. The user wearable wire control system of claim 1, wherein at least a portion of the sleeve is a material selected from a group consisting of cloth plastic, rayon, spandex, satin, and any combination thereof.

* * * * *